US012108917B2

(12) United States Patent
Howard

(10) Patent No.: US 12,108,917 B2
(45) Date of Patent: Oct. 8, 2024

(54) SEAT PROTECTOR

(71) Applicant: Dorothy Howard, Milwaukee, WI (US)

(72) Inventor: Dorothy Howard, Milwaukee, WI (US)

( * ) Notice: Subject to any disclaimer, the term of this patent is extended or adjusted under 35 U.S.C. 154(b) by 186 days.

(21) Appl. No.: 17/520,879

(22) Filed: Nov. 8, 2021

(65) Prior Publication Data

US 2023/0146959 A1 May 11, 2023

(51) Int. Cl.
*A47K 13/16* (2006.01)

(52) U.S. Cl.
CPC ..... *A47K 13/16* (2013.01)

(58) Field of Classification Search
CPC ..... A47K 13/16; A47K 13/145
USPC ..... 4/245.1–245.9
See application file for complete search history.

(56) References Cited

U.S. PATENT DOCUMENTS 2,093,168 A 9/1937 Hamer
3,753,262 A 8/1973 Watsky
5,144,698 A * 9/1992 McKenzie ..... A47K 13/14 4/245.7
5,437,906 A 8/1995 Snuggs
5,557,809 A * 9/1996 Adams ..... A47K 13/16 4/245.3
6,813,784 B1 11/2004 Thompson
8,196,228 B1 * 6/2012 Gyurjyan ..... A47K 13/16 4/245.1
8,621,675 B2 1/2014 Aspiro
2008/0244814 A1 10/2008 Martin
2012/0246811 A1 10/2012 Sayre
2015/0059073 A1 3/2015 Ciriclio
2017/0107708 A1 4/2017 Covington
2020/0022541 A1 1/2020 Brown

FOREIGN PATENT DOCUMENTS

GB 2169011 A 7/1986

OTHER PUBLICATIONS

PCT International Patent Application No. PCT/US22/49139, International Search Report and Written Opinion of the International Searching Authority dated Feb. 1, 2023, 8 pages.

* cited by examiner

*Primary Examiner* — Tuan N Nguyen
(74) *Attorney, Agent, or Firm* — James B. Conte; Craig R. Miles; CR MILES P.C.

(57) ABSTRACT

A toilet seat protector includes a seating section. The seating section includes a passage with a passage first end and a passage second end spaced from said first end along a pathway. An open front toilet seat extends into the passage of the seating section. An overlay can extend away from the seating section of said toilet seat protector. The overlay lays over an end wall surface, front side surface, and side side surface of a toilet bowl.

11 Claims, 9 Drawing Sheets

SEAT PROTECTOR

I. FIELD OF THE INVENTION

The present disclosure concerns a toilet seat protector having a first passage with a first passage first end and a first passage second end. The first passage first end and first passage second end spaced apart from each other along a pathway. The protector includes a second passage with a second passage first end and a second passage second end. The second passage first end and second passage second end spaced apart from each other along a pathway. The protector when installed on an open front toilet seat includes a first toilet seat half in the first passage and a second toilet seat half in the second passage.

II. BACKGROUND OF THE INVENTION

The International Association of Plumbing and Mechanical Officials' Uniform Plumbing Code, section 409.2.2, requires that "all water closet seats, except those within dwelling units or for private use, shall be of the open front type". There is an exception for toilets with an automatic toilet seat cover dispenser. The code is followed by most public authorities, many public toilets feature open front toilet seats.

U.S. Pat. No. 3,753,262, Benjamin Watsky, discloses a disposable toilet seat cover of improved design so to prevent contact of a person's body with the toilet seat on which he sits, the cover consisting of a tissue paper panel for placement upon the toilet seat, and a center of the panel having a large number of radially extending slits so to form a great many triangular tabs that hang down into the toilet bowl and which thus cover the inner periphery of the toilet seat, while at the same time forming a central oval shaped opening.

United States Patent Publication No. 2012/0246811, Martha Sayre, discloses a disposable toilet seat protector. In one embodiment, a toilet seat cover may include a seat portion having an opening approximately center thereto and a skirt portion on an outer periphery thereto. The seat portion may have a polygonal configuration; however, other geometric configurations are within the scope of the invention. The opening may be defined by a collar. Elastic may define a border between the cover and the skirt. A neck or handle portion may be located at a back portion of the cover providing a means for a user to position the cover on a toilet seat. In one embodiment, a toilet seat cover may include a seat portion having an opening approximately center thereto and a skirt portion on an outer periphery thereto. The seat portion may have an oval configuration; however, other geometric configurations are within the scope of the invention. The opening may be defined by a collar. Elastic may define a border between the cover and the skirt. A neck or handle portion may be located at a back portion of the cover providing a means for a user to position the cover on a toilet seat.

United States Patent Publication No. 2017/0107708, Christopher Covington, discloses a protector configured to cooperate with a toilet having a bowl with an upper surface and a seat that can be selectively raised and lowered. The protector includes a body and a flange member extending outwardly from the body. The flange member is configured to removably cooperate with the upper surface of the bowl and the upper surface of the seat depending on whether the seat is raised or lowered. The distal portion of the body of the protector is disposed below the flange member while the proximal portion of the body extends generally upwardly above the flange member. In addition, the distal portion of the body is configured to extend into a bowl of a toilet while the flange member rests on the upper surface of the bowl or the upper surface of the seat.

United States Patent Publication No. 2020/002541, Natasha Brown, discloses a portable and washable sanitary toilet seat protector for providing assurance of hygienic protection during use of commode toilet seats. In particular, the seat protector is formed with a primarily elliptical opening framed by a top surface and a non-slip textured undersurface. The undersurface thereby facilitates a friction-enhanced contact with the top surface of the toilet seat. The seat protector provides a collapsible feature enabling the seat protector to be compressed into a smaller size for storage in a compatible pouch, said pouch also featuring a cord with connectors compatible with fasteners within the pouch interior and with fasteners on the side tabs on the seat protector. The seat protector is preferably made of biodegradable material such as plastic, recycled paper, or the like, and further, may be pre-sanitized.

III. SUMMARY OF THE INVENTION

In one example of the invention a toilet seat protector includes a seating section. The seating section includes a passage with a passage first end and a passage second end spaced from said first end along a pathway. When the seat protector resides in an installed orientation on an open front toilet seat, the open front toilet seat extends into the passage of the seating section of the toilet seat protector. An overlay can extend away from the seating section of said toilet seat protector. The overlay lays over a surface of a toilet bowl uncovered by said toilet seat when the toilet seat resides in a down position and when said toilet seat protector resides in the installed orientation. The surface laid over by the overlay includes an end wall surface, front side surface, and side side surface of the toilet bowl.

In a further embodiment, the seating section forms a first seating section, the passage forms a first passage having said first end and second end. The toilet seat extending into the first passage forms a toilet seat first half. In this embodiment the toilet seat protector further includes a second seating section. The second seating section includes a second passage with a second passage first end and a second passage second end spaced from the second passage first end along a pathway. When the toilet seat protector resides in an installed orientation on the open front toilet seat, a second half of the open front toilet seat extends in the second passage. The toilet seat protector further includes a first overlay extending away from the first seating section of the toilet seat protector. The protector further includes a second overlay extending away from the second seating section of said toilet seat protector. The first overlay and second overlay each lay over surfaces of a toilet bowl uncovered by said first and second toilet seat halves when said toilet seat resides in a down position and when said toilet seat protector resides in said installed orientation. Each of the surfaces laid over by said first and second overlays includes end wall surfaces, front side surfaces, and side side surfaces of the toilet bowl.

Naturally, further objects of the invention are disclosed throughout other areas of the specification, drawings, photographs, and claims.

IV. BRIEF DESCRIPTION OF THE DRAWINGS

V. DETAILED DESCRIPTION OF THE INVENTION

Figure 1A:
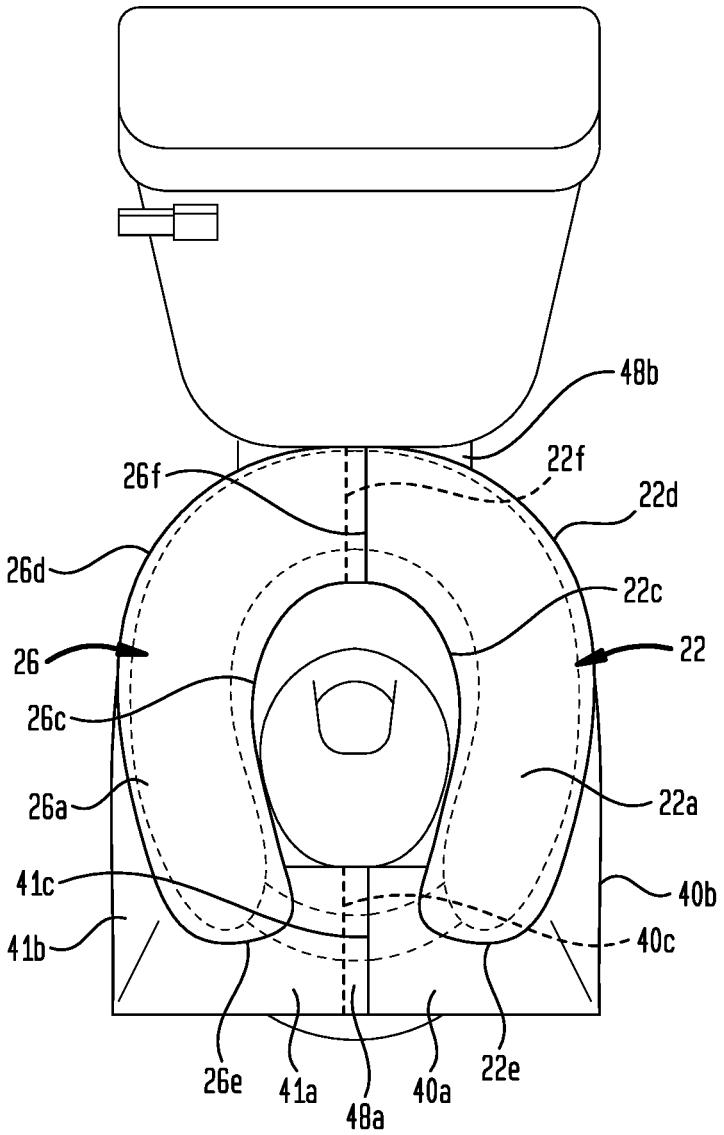
FIG. 1A is a top view of a toilet having a toilet bowl, toilet tank and toilet seat; a toilet seat protector, embodying features of the invention, resides on the toilet seat.
Figure 1B:
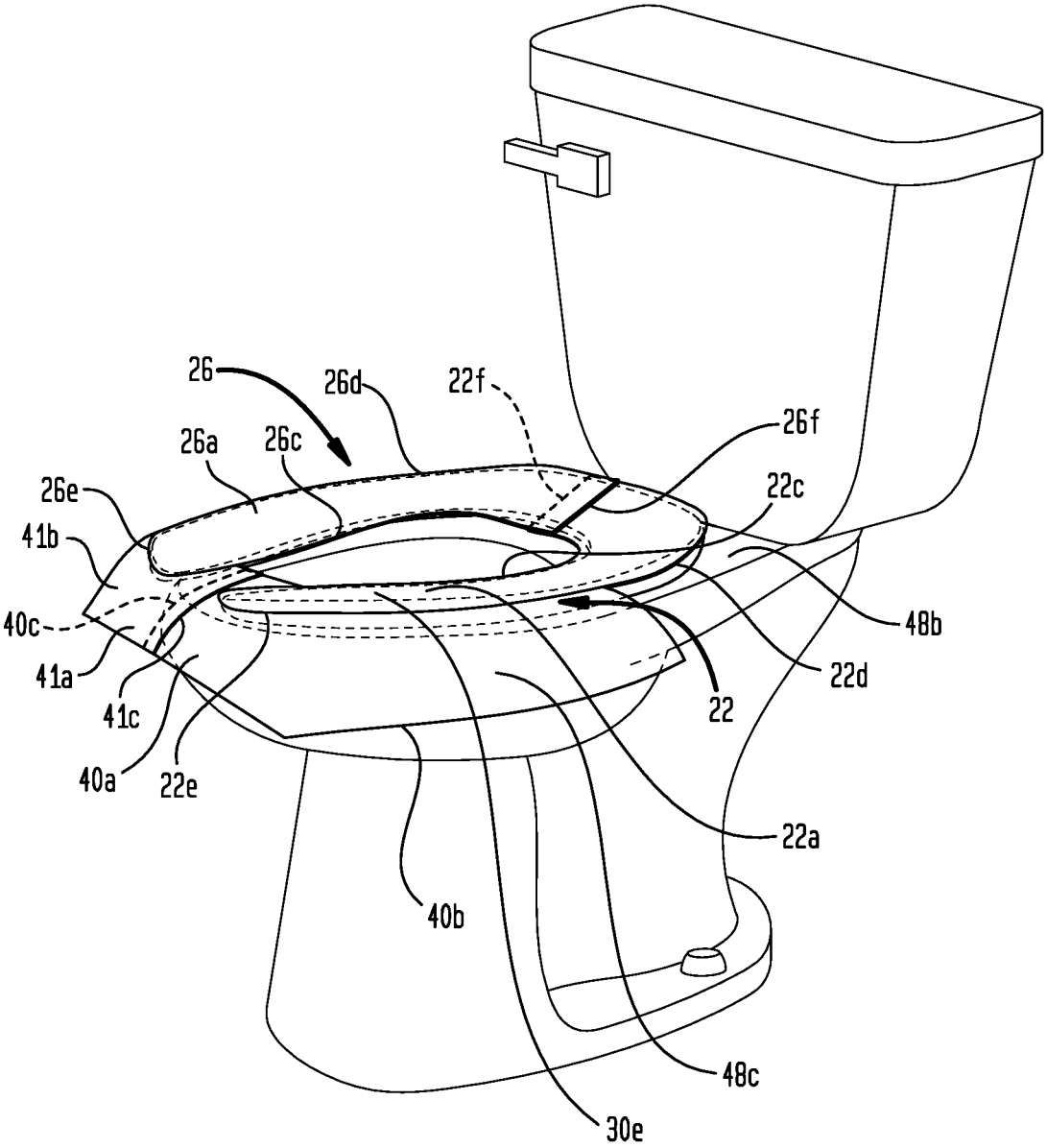
FIG. 1B is an isometric right sided, top view of the toilet having the toilet bowl, toilet tank, toilet seat, and toilet the seat protector shown in FIG. 1A.
Figure 1C:
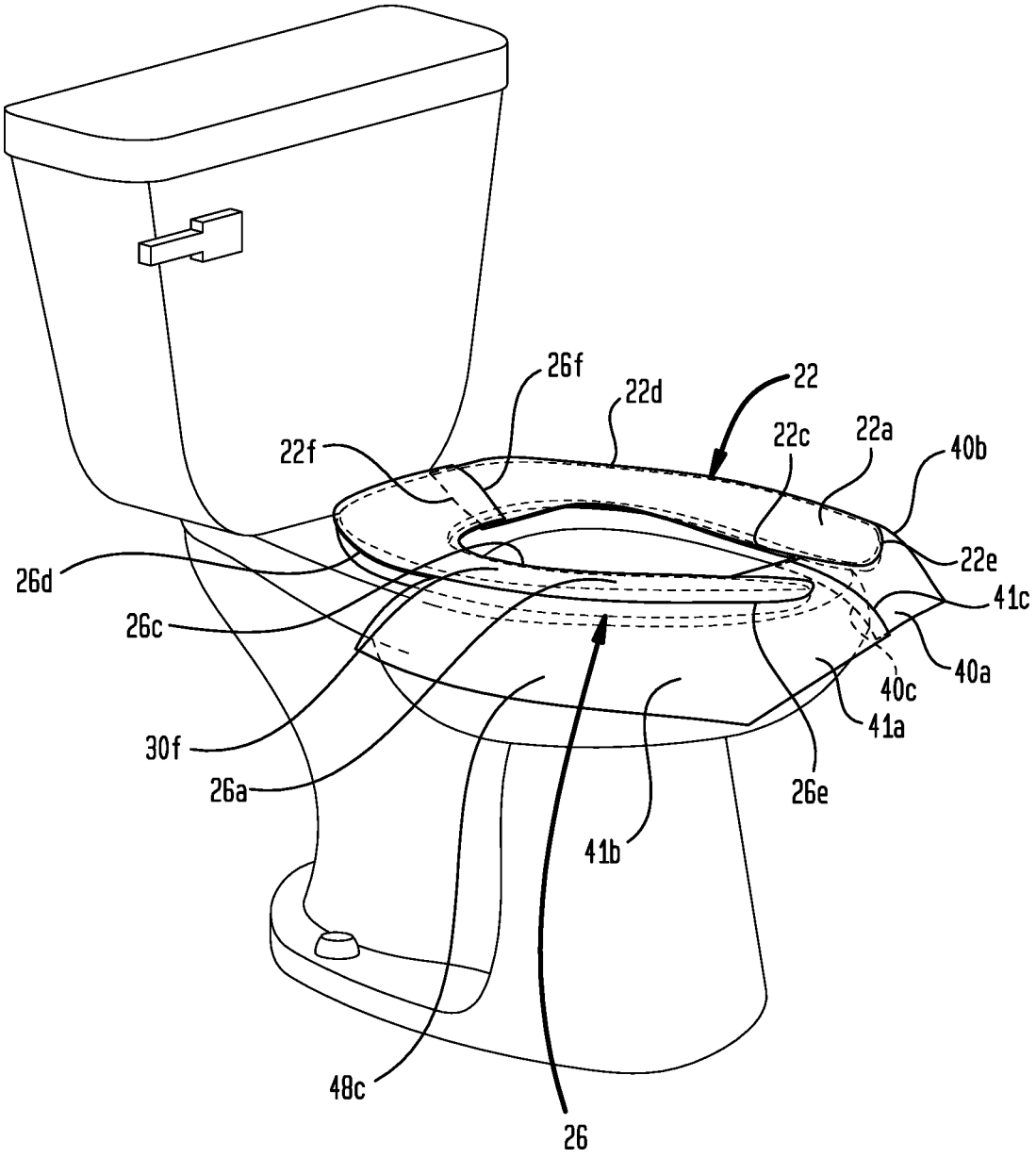
FIG. 1C is an isometric left sided, top view of the toilet having the toilet bowl, toilet tank, toilet seat, and toilet the seat protector shown in FIG. 1.
Figure 2:
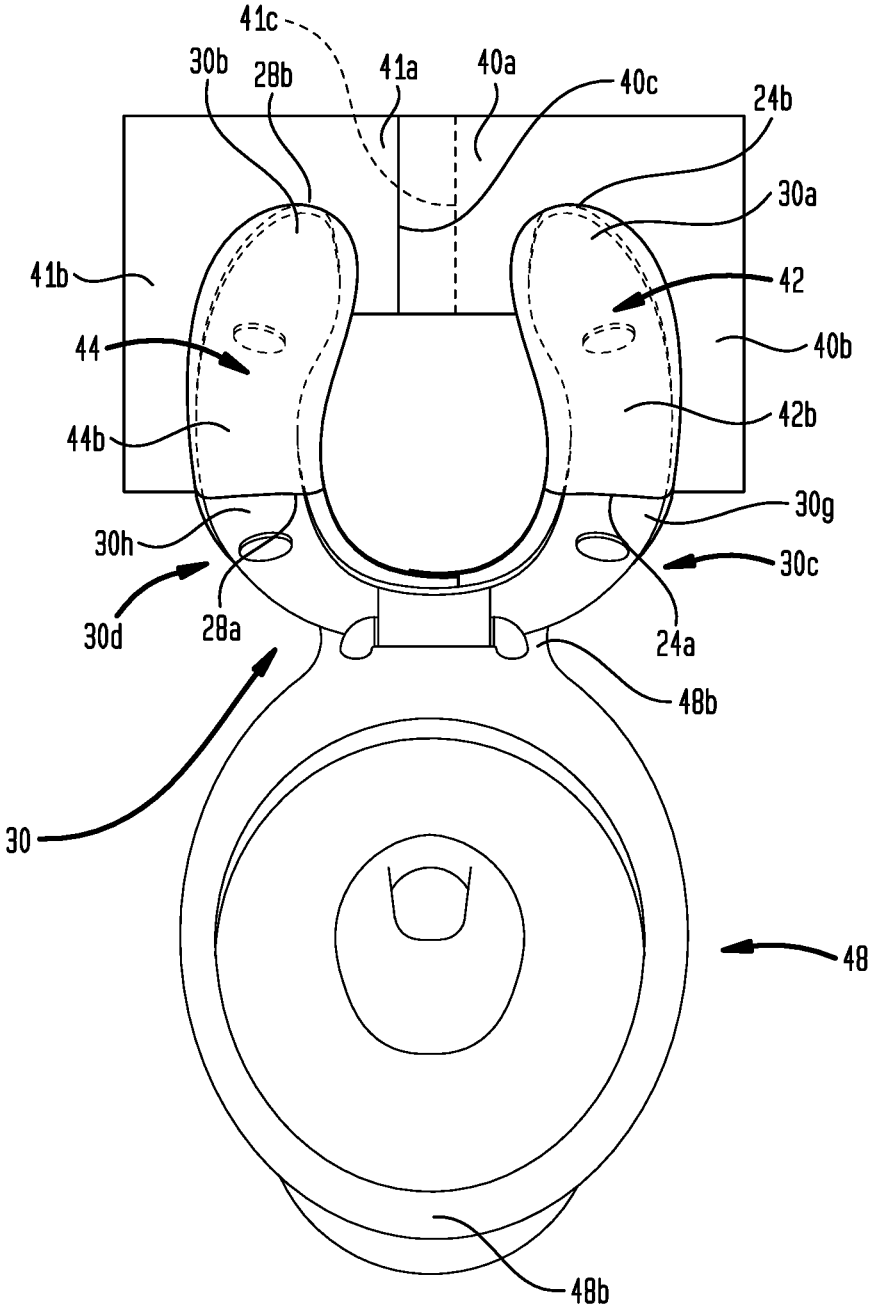
FIG. 2 is a top view of the toilet having the toilet bowl, toilet tank, toilet seat, and the toilet seat protector shown in FIG. 1A except the toilet seat is in the up as opposed to the down position.
Figure 3:
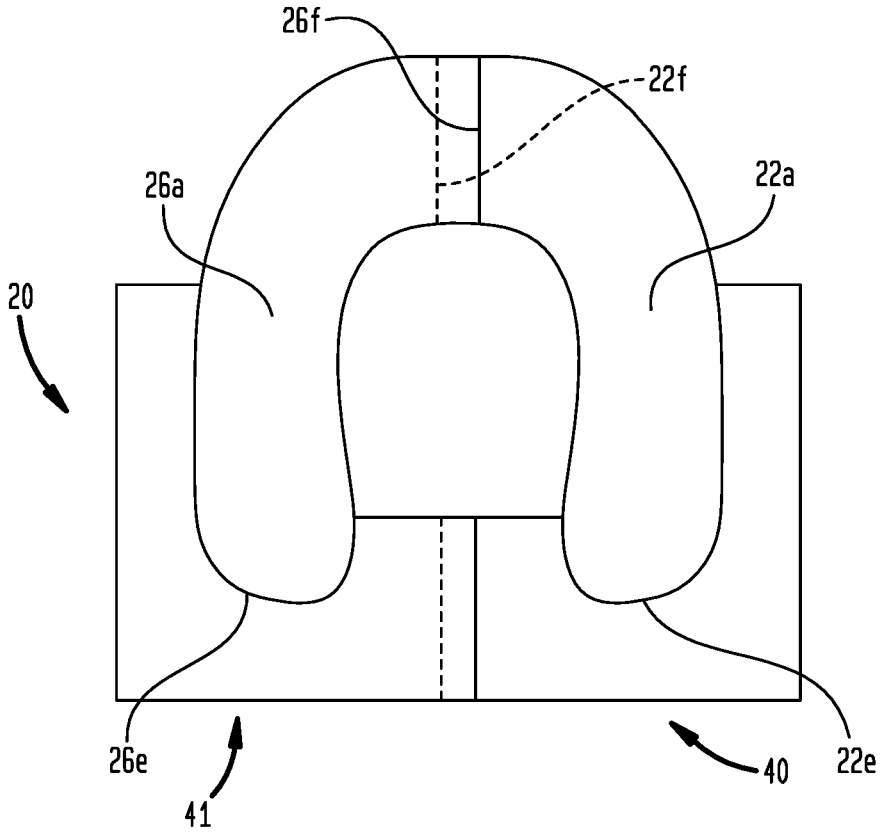
FIG. 3 is a top view of the toilet seat protector shown in FIG. 1A exclusive of the toilet.
Figure 4:
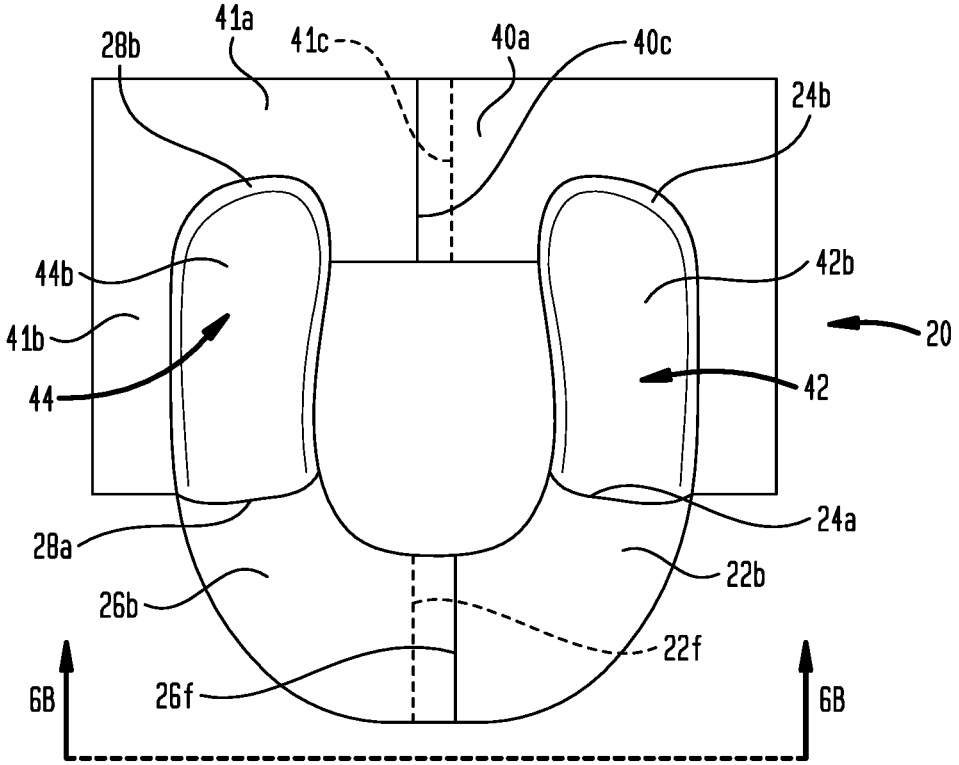
FIG. 4 is a bottom view of the toilet seat protector shown in FIG. 3.
Figure 5:
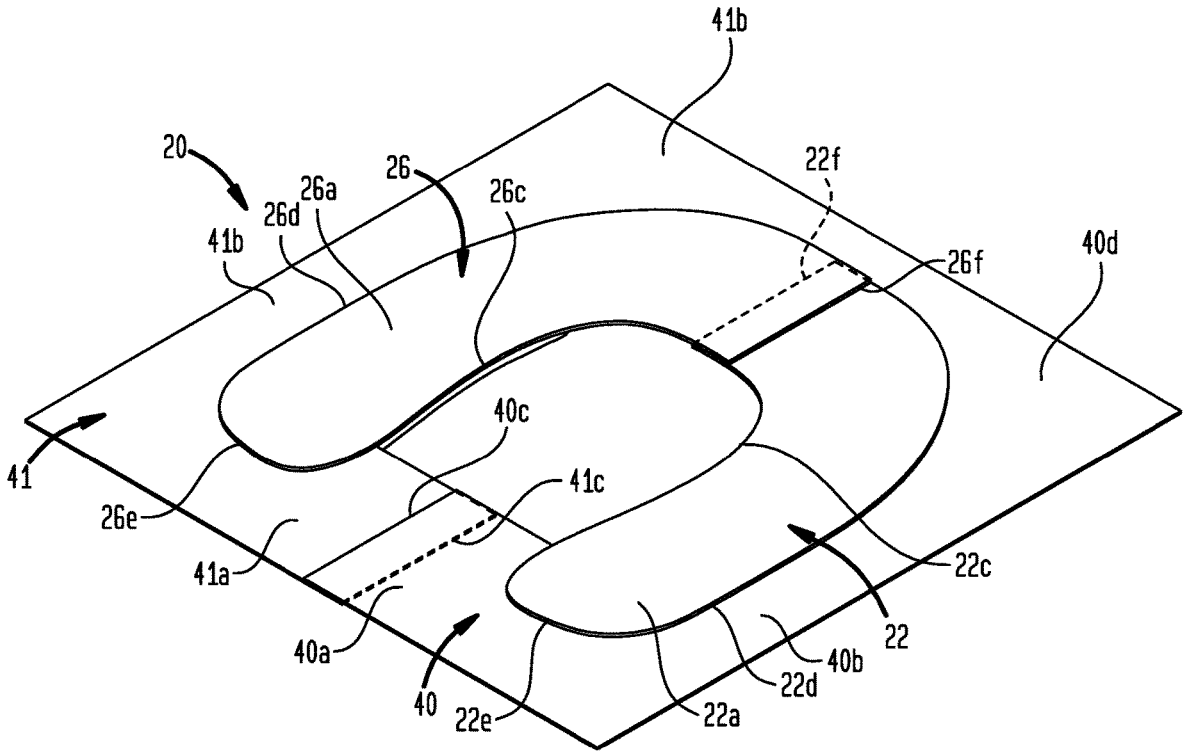
FIG. 5 is a top isometric view of an alternative embodiment of the toilet seat protector shown in FIG. 3.

Generally, referring to FIGS. 1A through 10, a toilet seat protector (20) includes a first seating section (22) including a first passage (24) with a first passage first end (24*a*) and a first passage second end (24*b*) spaced from said first end along a pathway. The seat protector includes a second seating section (26) including a second passage (28) with a second passage first end (28*a*) and a second passage second end (28*b*). The second passage first end (28*a*) and second passage second end (28*b*) spaced apart from each other along a pathway. The protector (20) when installed on an open front toilet seat (30) includes a first front free end (30*a*) of the open front toilet seat (30) in the first passage (24) and a second front free end (30*b*) of the open front toilet seat (30) in the second passage (28). A first seating surface (22*a*) of the first seating section (22) overlaps a seating surface (30*e*) of a first half (30*c*) of the open front toilet seat (30). A first overlay surface (22*b*) of the first seating section (22), facing a direction opposite the seating surface (22*a*) faces, overlays, and contacts the seating surface (30*e*) of the first half of the toilet seat (30*c*). A second seating surface (26*a*) of the second seating section (26) overlaps a seating surface (30*f*) of the second half (30*d*) of the toilet seat. A second overlay surface (26*b*) of the second seating section (26) facing a direction opposite the second section seating surface (26*a*) faces, overlays, contacts and faces the seating surface (30*f*) of the second half (30*d*) of the toilet seat. Overlays (40, 41) extending way from and from the first seating section (22) and second seating section (26) overlay portions of the toilet bowl not covered by the open front toilet seat (30).

In more detail the first seating section (22) of said protector (20) includes an internal surface (22*b*') delimiting an internal periphery forming the first passage (24). The internal surface (22*b*') forms a part of the first overlay surface (22*b*) of the first seating section. The first seating section includes an external surface (22*a*) forming the seating surface (22*a*). The first seating section (22) includes a first underside section (42) which includes an internal surface (42*a*) delimiting said first passage (24). The first underside section (42) includes an external surface (42*b*) which faces in a direction opposite of said first seating surface (30*e*) and in a same direction as the first underside surface (30*g*) of the first toilet seat half. The underside section (42) forms a first underside (42) of the first seating section (2). The external surface (42*b*), when the first seating section (22) resides in an installed orientation, resides on the side (30*g*) of the toilet seat opposite the toilet seats seating surface (30*e*). The side (30*g*) can be an underside.

The first seating section (22) includes a first side portion (22*c*) which can form a curvilinear side with a curvilinear side surface. The curvilinear side can be concave. The first seating section (22) includes a second side portion (22*d*) which can comprise a second curvilinear side with a second curvilinear side surface. The second curvilinear side can be convex. The first side (22*c*) can form an inner side of the first seating section and the second side (22*d*) can form an outer side of the first seating section. The first (22*c*) and second (22*d*) side can be joined to each other by a side (22*e*) at a front of the first section. The first (22*c*) and second sides (22*d*) can be joined to each other by a side (22*f*) at a rear of the first seating section.

The second seating section (26) of said protector (20) includes an internal surface (26*b*') delimiting an internal periphery forming the second passage (28). The internal surface forms a part of the second overlay surface (26*b*) of the second seating section (26). The second seating section (26) includes an external surface (26*a*) forming the second seating surface (26*a*). The second seating section (26) includes a second underside section (44) which includes an internal surface (44*a*) delimiting said second passage (28). The second underside section (44) of the second seating section (26) includes an external surface (44*b*) which faces in a direction opposite of said second seating surface (26*a*). The external surface forms an underside surface (26*a*). The underside section (44), when the second seating section resides in an installed orientation, resides on the side (30*h*) of the toilet seat opposite the toilet seats seating surface. The side (30*h*) can be an underside.

The second seating section (26) includes a first side portion (26*c*) which can comprise a first curvilinear side with a first curvilinear side surface. The curvilinear side can be concave. The second seating section (26) includes a second side portion (26*d*) which can comprise a second curvilinear side with a second curvilinear side surface. The curvilinear side can be convex. The first side (26*c*) of the second seating section (26) can form an inner side of the second seating section (26) and the second side (26*d*) can form an outer side of the second seating section (26). The first (26*c*) and second side (26*d*) can be joined to each other by a side (26*e*) at a front of said second seating section (26). The first (26*c*) and second (26*d*) sides can be joined to each other by a side (26*f*) at a rear of the second seat section (26).

As can be seen in FIGS. 1A, 1B, 2, and 5, a first toilet bowl overlay (40) extends away from and from the first seating section (22) of the toilet protector. A front toilet bowl side portion (40*a*) of the toilet bowl overlay (40) when the protector is installed, overlaps a front side surface (48*a*) of the toilet bowl (48). The front toilet bowl side portion (40*a*) of the toilet bowl overlay has a width of at least 1 times the width of the rim of the toilet bowl at the front of the toilet bowl. A first toilet bowl forward side portion (40*b*) of the toilet bowl overlay overlaps a forward side (48*c*) surface at a forward side of the bowl (48). The first toilet bowl forward side portion (40*b*) of the toilet bowl overlay has a width of at least 1 times the width of the rim of the toilet bowl at the front of the toilet bowl. The toilet bowl overlay having, an upper toilet bowl side portion (40*c*), further overlaps a portion of the toilet bowl end wall (48*b*) facing the same direction as the toilet seat seating surface (30*e*) and which delimits an end of the bowl (48) opposite the base. The end wall portions (48*b*) overlapped can be at the front of the bowl and rear of the bowl, each portion overlapped uncovered when the toilet seat resides in the down position. The upper toilet bowl portion (40*c*) of the toilet bowl overlay has a width of at least 1 times the width of the rim of the toilet bowl at the front of the toilet bowl. As is appreciated from the description herein and FIGS. 1B, 2 and 5, the first toilet bowl overlay (40) protects the upper, front and forward side surface of the toilet bowl. The material providing the protection forms an overlap with the toilet bowl (48). The width of the material is at least 1 times the width of the rim of the toilet bowl at the front of the toilet bowl. See FIGS. 1A, 1B, 2, and 5.

As can be seen in FIGS. 1A, 1C, 2, and 5, a second toilet bowl overlay (41) extends away from and from the second seating section (26) of the toilet seat protector 20. A second front toilet bowl side portion (41*a*) of the toilet bowl overlay (41) when the protector is installed overlaps a front side surface (48*a*) of the bowl (48). The second front toilet bowl side portion (41*a*) of the toilet bowl overlay has a width of at least 1 times the width of the rim of the toilet bowl at the front of the toilet bowl. A second toilet bowl forward side portion (41*b*) overlaps a side surface at a forward side of the bowl (48). The second toilet bowl forward side portion has a width of at least 1 times the width of the rim of the toilet bowl at the front of the toilet bowl. The upper toilet bowl portion (41*c*) of the toilet bowl overlay further overlaps a portion of the toilet bowl end wall (48*b*) facing the same direction as the toilet seat surface (30*e*) and which delimits an end of the bowl opposite the base. The end wall portions (48*b*) overlapped can be at the front of the bowl and rear of the bowl, each portion overlapped uncovered when the toilet seat (30) resides in the down position. The upper toilet bowl portion of the overlay at the end wall (48*b*) at the front of the bowl has a width of at least 1 times the width of the rim of the toilet bowl at the front of the toilet bowl. As is appreciated from the description herein and FIGS. 1C, 2, and 5, the second overlay (41) protects the upper, front and forward side surface of the toilet bowl. The material providing the protection forms an overlap with the toilet bowl (48). The width of the material is at least 1 times the width of the rim of the toilet bowl at the front of the toilet bowl. See FIGS. 1A, 1C 2, and 5.

The first seat section's first side (22*c*) can be continuous or discontinuous with the second seat sections first side (26*c*). Likewise, the first seat section's second side (22*d*) can be continuous or discontinuous with the second seat section's second side (26*d*). The first (22) and second (26) seat sections at their rear (22*f*, 26*f*) can be continuous or discontinuous with each other. Further the first seat section (22) and second seat section (26), at the rear (22*f*, 26*f*), can overlap each other. The first seat section's (22) front and the second (26) seat section's front can be joined together at a front (22*f*, 26*f*) of the seat protector (22). The first overlay (40) and second overlay (41) can be joined together where they overlap the end wall portions (48*b*) at the front of the bowl and rear of the bowl. The first overlay (40) and second overlay (41) can overlap each other. The overlap can occur at the front (40*c*, 41*c*) of the overlays and at the rear (40*d*, 41*d*) of the overlays. The first (22) and second (26) seat sections and their respective overlays (40, 41) can be separated from each other forming two separate components of the seat protector. In this case the above described overlapping is preferable.

The first end (24*a*, 28*a*) of each of the first (24) and second (28) passage can be an open end. The first front free end (30*a*) of the toilet seat ingresses into the first passage (24) through the passages first open end (24*a*). The second end (24*b*) of the first passage (24) can be closed and provide an abutment against which the first free end abuts when in an installed orientation with the first seating section. A tapering of the passage (24) or the expansion of the width of toilet seat first half (30*c*) can provide a friction fit between the first toilet seat half (30*c*) and the first seating section (22) to prevent further ingress of the first front free end (30*a*) or toilet seat half (30*c*) into the first passage. The second end (24*b*) of the first passage can be open. The first front free end (30*a*) can pass through the first open end (24*a*) and the second open end (24*b*) of the passage (24). The tapering of the passage (24) and/or or expansion of the width of seat (30) can stop ingress of the first toilet seat half (30*c*) through the passage (24).

The second front free end (30*b*) of the toilet seat ingresses into the second passage (28) through the passages first open end (28*a*). The second end (28*b*) of the second passage (28) can be closed and provide an abutment against which the second free end abuts (30*b*) when in an installed orientation with the second seating section (26). A tapering of the passage (28) or the expansion of the width of toilet seat second half (30*d*) can provide a friction fit between the second toilet seat half (30*d*) and the second seating section (26) to prevent further ingress of the second front free end (30*b*) or toilet seat half (30*d*) into the second passage (28). The second end (28*b*) of the second passage (28) can be open. The second front free end (30*b*) can pass through the first open end (28*a*) and the second open end (28*b*) of the passage (28). The tapering of the passage (28) and/or or expansion of the width of seat (30) can stop ingress of the second toilet seat half (30*d*) through the passage (28). A friction fit between the second toilet seat half and the second seating section to prevent further ingress of the second front free end into the second passage.

Each second end (24, 28*b*) of the first (24) and second (28) passage can be open. The openings can open into and be continuous with one and other. The first (24) and second (28) passage can form a continuous passage extending from the first open end (24*a*) of the first passage (24) to the first open (28*a*) end of the second passage (28).

The first seating surface (22*a*) of the first seating section (22) and the first overlay surface (22*b*) of the first seating section (22) form a first panel of the first seating section (22). The first underside section (42) of the first seating section (22) forms a second panel. The first panel and second panel delimit the first passage (24). The first overlay (40) extending from the first seating section (22) forms a first skirt.

Figure 6A:
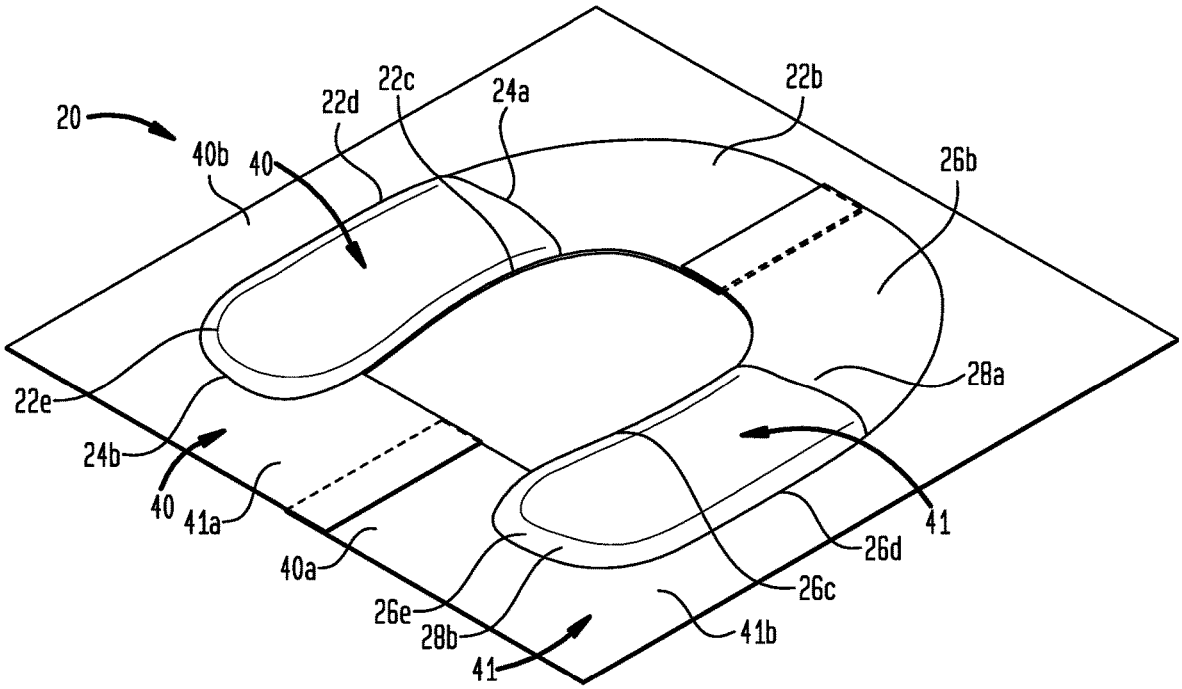
FIG. 6A is a bottom (underside) isometric view of the toilet seat protector shown in FIG. 5.
Figure 6B:
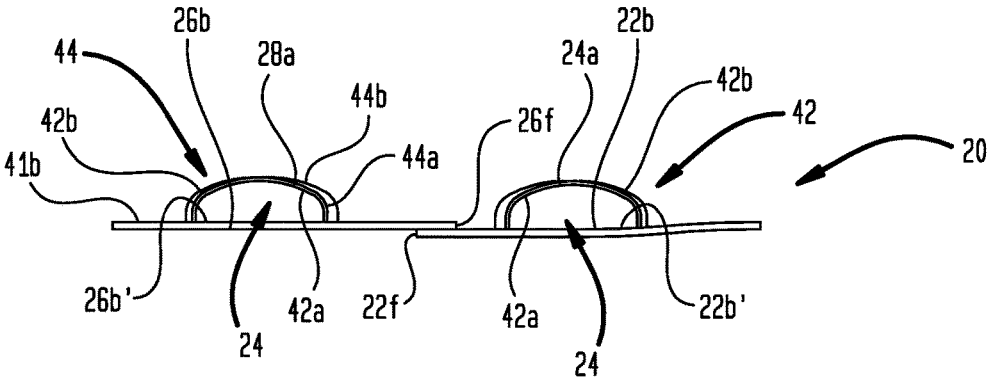
FIG. 6B is an end view of the toilet seat protector shown in FIG. 6A looking into passages at the underside of the seat protector.
Figure 7:
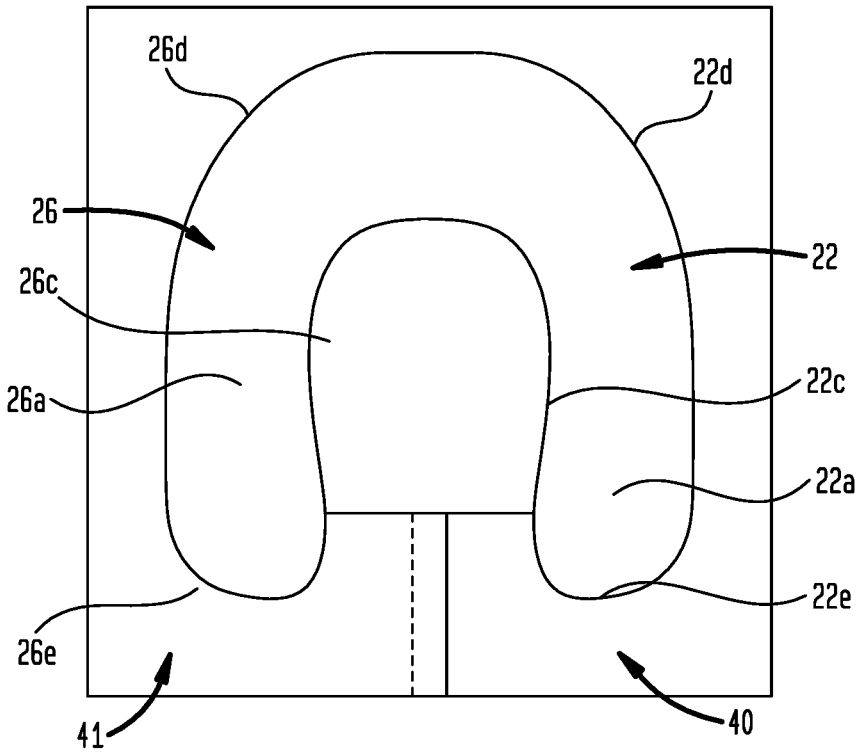
FIG. 7 is a top view of an alternative embodiment of the toilet seat protector shown in FIG. 5.
Figure 8:
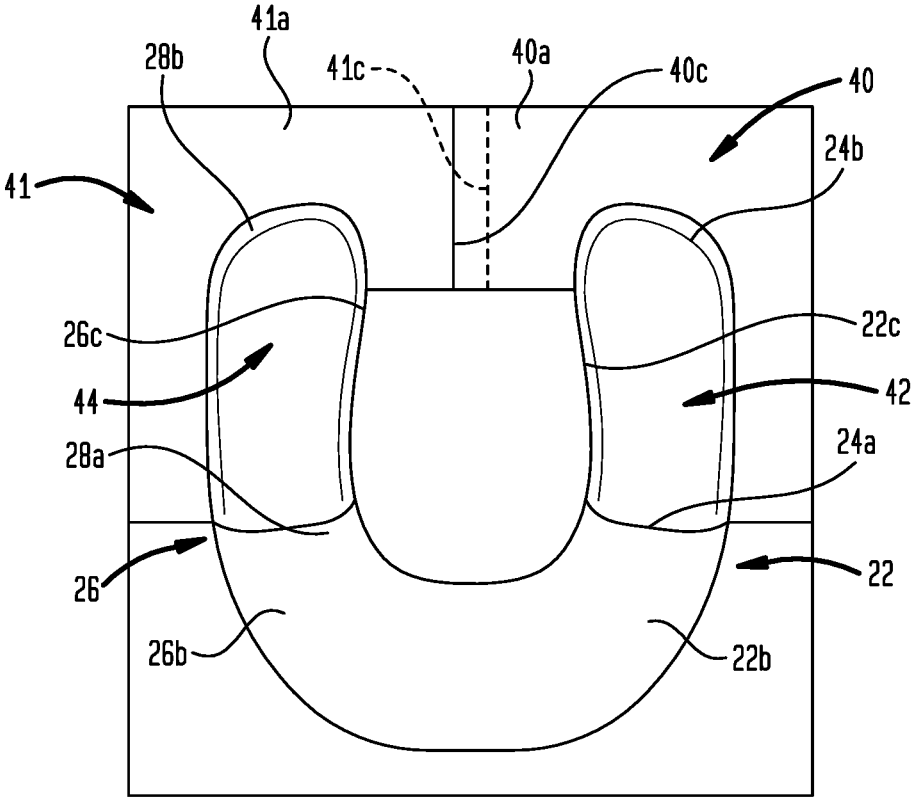
FIG. 8 is a bottom view of the alternative embodiment of the toilet seat protector shown in FIG. 7.
Figure 9:
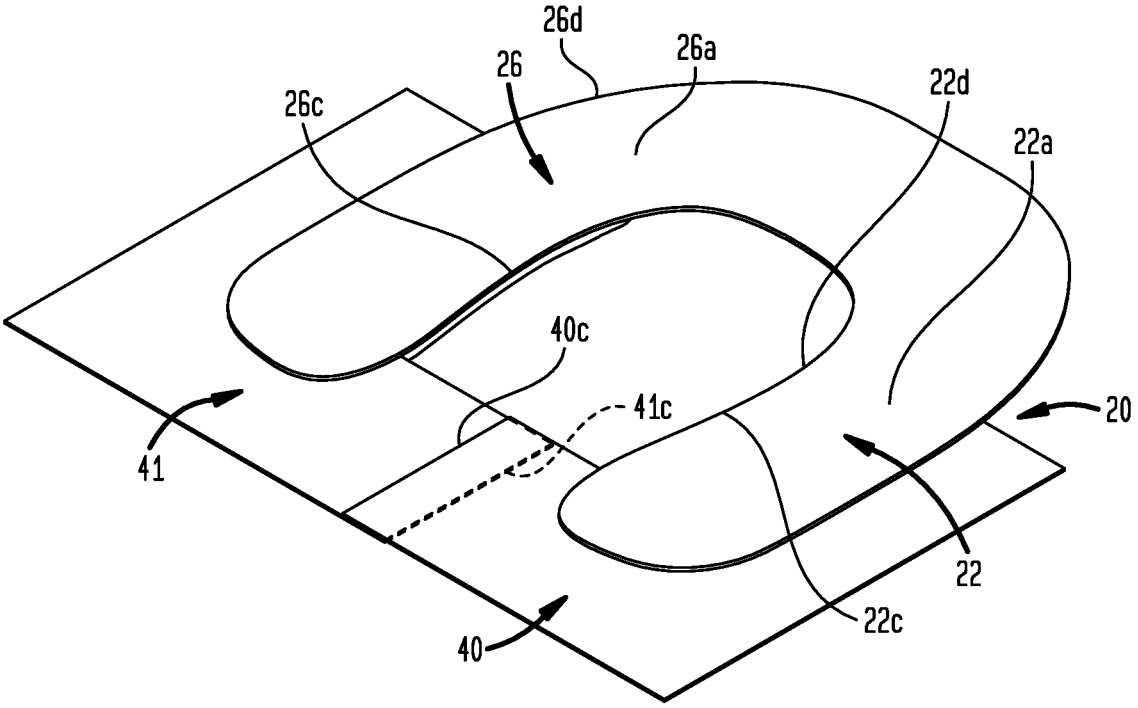
FIG. 9 is a top isometric view of an alternative embodiment of the toilet seat protector shown in FIG. 7.
Figure 10:
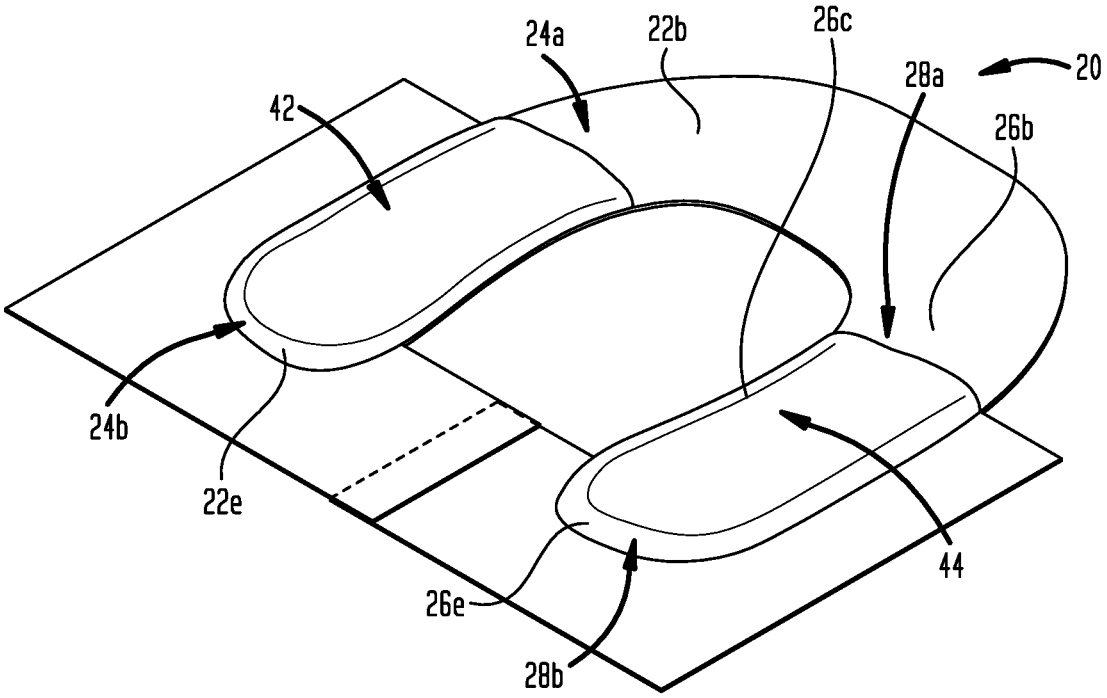
FIG. 10 is a bottom isometric view of the alternative embodiment of the toilet seat protector shown in FIG. 9.

As made clear by the above description and FIGS. 6B, 8 and 10, the first passage (24) forms a passage of a first pocket and said first open end (24*a*) forms a first opening which opens out of said pocket into an environment external to said passage. The second passage (28) forms a passage of a second pocket, said second open end (28*a*) forms a second opening which opens out of said second pocket into said environment external to the passage. The first open end (24*a*) of the first passage and said second open end (28*a*) said second passage form separate openings without an enclosed passage.

The second seating surface (26*a*) of the second seating section (26) and the second overlay surface (26*b*) of the second seating section (26) form a first panel of the second seating section (26). The second underside section (44) of the second seating section (26) forms a second panel of the second seating section (26). The first panel and second panel delimit the second passage (28). The second overlay (41) extending from the second seating section (26) forms a second skirt.

Now considering a method of making the toilet seat protector (20), the method can include configuring a first passage (24) as part of a first seating section (22). The passage is configured to include a passage first end (24*a*) spaced from a passage second end (24*b*). The method further includes configuring a second passage (28) as part of a second seating section (26); said second passage (28) configured to have a second passage first end (28*a*) and a second passage second end (28*b*).

Now referring to the method in more detail, it includes forming a seating surface (22*a*) and an oppositely facing overlay surface (22*b*) of said first seating section (22). It also includes forming a seating surface (26*a*) and an oppositely facing overlay surface (26*b*) of said second seating section. In connection with fabricating the first passage, the method additionally includes forming an underside section (42) with an internal surface (42*a*) to delimit an interior of said first passage (24). The method also includes forming said overlay surface (24*b*) of said first seating section to have an internal surface also delimiting an interior of said first passage. In connection with fabricating the second passage, the method includes forming an underside section (44) with an internal surface (44*a*) to delimit an interior of said second passage (28). The method also includes forming said overlay surface (26*b*) of said second seating section to have an internal surface also delimiting an interior of said second passage.

The method further includes extending a first overlay (40) away from said first seating section (22) of said toilet seat protector (20); extending a second overlay (41) away from said second seating section (26) of said toilet seat protector. The first (40) and second (41) overlay are each sized to lay over surfaces of a toilet bowl (48) uncovered by a toilet seat (30) when the toilet seat resides in a down position and when the toilet seat protector resides in an installed orientation.

As can be easily understood from the foregoing, the basic concepts of the present invention may be embodied in a variety of ways. The invention involves numerous and varied embodiments of a toilet seat protector and methods for making and using such protector.

As such, the particular embodiments or elements of the invention disclosed by the description or shown in the figures accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of an "overlay" should be understood to encompass disclosure of the act of "overlaying"—whether explicitly discussed or not—and, conversely, were there is a disclosure of the act of "passing through", such a disclosure should be understood to encompass disclosure of a "passage" and even a "means for passing through". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Further, for the purposes of the present invention, the term "coupled" or derivatives thereof can mean indirectly coupled, coupled, directly coupled, connected, directly connected, or integrated with, depending upon the embodiment.

Additionally, for the purposes of the present invention, the term "integrated" when referring to two or more components means that the components (i) can be united to provide a one-piece construct, a monolithic construct, or a unified whole, or (ii) can be formed as a one-piece construct, a monolithic construct, or a unified whole. Said another way, the components can be integrally formed, meaning connected together so as to make up a single complete piece or unit, or so as to work together as a single complete piece or unit, and so as to be incapable of being easily dismantled without destroying the integrity of the piece or unit.

Thus, the applicant(s) should be understood to claim at least: i) each of the seat protector herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application incorporates or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon. The elements following an open transitional phrase such as "comprising" may in the alternative be claimed with a closed transitional phrase such as "consisting essentially of" or "consisting of" whether or not explicitly indicated the description portion of the specification.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A toilet seat protector comprising:

a first seating section, said first seating section comprising:

a first passage with a first end and a second end spaced from said first end along a pathway, wherein;

said first passage configured to receive, during installation of said toilet seat protector on an open front toilet seat, a first portion of said open front toilet seat;

a second seating section, said second seating section comprising:

a second passage with a first end and a second end spaced from the first end along a pathway, wherein;

said second passage configured to receive, during installation of said toilet seat protector on said open front toilet seat, a second portion of said open front toilet seat;

a first toilet bowl overlay extending away from said first seating section of said toilet seat protector; said first toilet bowl overlay having a construction comprising:

an upper toilet bowl portion configured to overlap a portion of a toilet bowl end wall at the front of a toilet bowl, said upper toilet bowl portion having a width at least 1 times the width of a rim of the toilet bowl, the rim being at a front of the toilet bowl;

a front toilet bowl side portion extends away from said first seating section and is configured to overlap a front side surface of the toilet bowl, said front toilet bowl side portion having a width of at least 1 times the width of the rim of the toilet bowl, the rim being at the front of the toilet bowl;

a first toilet bowl forward side portion configured overlap a forward side surface at a forward side of the toilet bowl, said first toilet bowl forward side portion having a width of at least 1 times the width of the rim of the toilet bowl, the rim being at the front of the toilet bowl;

a second toilet bowl overlay extending away from said second seating section of said toilet seat protector; said second toilet bowl overlay having a construction comprising:

a second front toilet bowl side portion configured overlap a front side surface of the toilet bowl, the second front toilet bowl side portion has a width of at least 1 times the width of the rim of the toilet bowl at the front of the toilet bowl;

a second toilet bowl forward side portion configured to overlap a side surface at a forward side of the toilet bowl, said second toilet bowl forward side portion having a width of at least 1 times the width of the rim of the toilet bowl, the rim being at the front of the toilet bowl;

a second upper toilet bowl portion configured to overlap a portion of the toilet bowl end wall at the front of the end wall; wherein, said first end of said first passage forms a first open end, said first passage forms a passage of a first pocket and said first open end forms a first opening which opens out of said pocket into an environment external to said passage;

said first end of said second passage forms a second open end; said second passage forms a passage of a second pocket, said second open end forms a second opening which opens out of said second pocket into said environment external to the passage.

2. The toilet seat protector of claim 1, wherein said first seating section comprising:

a first seating surface, said first seating surface configured to overlap and face a same direction of a seating surface of said first portion of said open front toilet seat;

a first underside surface, said first underside surface configured to face a direction opposite the direction the first seating surface faces; wherein the first upper toilet bowl side portion of said first toilet bowl overlay and said second toilet bowl upper side portion of said second toilet bowl overlay disconnected from each other.

3. The toilet seat protector of claim 2, wherein said first underside surface configured to contact the toilet seat seating surface.

4. The toilet seat protector of claim 1, wherein said second seating section of said toilet seat protector further comprising:

a second seating surface and a second underside surface;

said second seating surface of said second seating section of said toilet seat protector configured to overlap a seating surface of said second portion of said open front toilet seat, said second seating surface of said second seating section of said toilet seat protector configured to face in a same direction as said seating of said second portion of said open front toilet seat; and said second underside surface configured to face a direction opposite said the direction the second seating surface of toilet seat protector faces.

5. The toilet seat protector of claim 4, wherein said second underside surface configured to contact said seating surface of said second portion half of said open front toilet seat.

6. The toilet seat protector of claim 1, wherein said first seating section of said toilet seat protector further comprising:

an internal surface delimiting an internal periphery forming the first passage.

7. The toilet seat protector of claim 6, wherein said first seating section of said toilet seat protector further comprising:

an internal surface delimiting said first passage.

8. The toilet seat protector of claim 1, wherein said second seating section further comprising:

an internal surface delimiting said second passage; wherein, the first upper toilet bowl portion of said first toilet bowl overlay and said second upper toilet bowl portion of said second toilet bowl overlay disconnected from each other disconnected from other.

9. The toilet seat protector of claim 1, wherein said first open end of said first passage and said second open end of said second passage form separate openings without an enclosed passage joining the two.

10. A method of making the toilet seat protector comprising:

configuring a first passage of a first seating section of said toilet seat protector;

forming a first seating surface;

forming an internal surface delimiting an interior of said first passage;

configuring a second passage of a second seating section of said toilet seat protector;

forming a second seating surface;

forming an internal surface delimiting an interior of said second passage;

extending away from said first seating section of said toilet seat protector a first toilet bowl overlay;

extending away from said seating section of said toilet seat protector a second toilet bowl overlay;

forming a first upper toilet bowl portion of said first toilet bowl overlay to overlap a front end wall surface of a toilet bowl;

forming a second upper toilet bowl portion of said second toilet bowl overlay to overlap a front end wall surface of a toilet bowl; said first and second upper toilet bowl portions configured to reside disconnected with each other where they overlap the front end wall surface of the toilet bowl forming a front toilet bowl side portion of said first toilet bowl overlay to overlap a front outer side surface of said toilet bowl;

forming a first forward toilet bowl side portion of said toilet bowl overlay to overlap an outer first side surface at a forward first side of said toilet bowl.

11. A toilet seat protector comprising:

a first seating section, said first seating section comprising:

a first passage with a first end and second end spaced from said first end along a pathway, wherein;

said first passage configured to receive, during installation of said toilet seat protector on an open front toilet seat, a first portion of said open front toilet seat;

a second seating section, said second seating section comprising:

a second passage with a first end and a second end spaced from the first end along a pathway, wherein;

said second passage configured to receive, during installation of said toilet seat protector on said open front toilet seat, a second portion of said open front toilet seat;

a first toilet bowl overlay extending away from said first seating section of said toilet seat protector; said first toilet bowl overlay having a construction comprising:

an upper toilet bowl portion which extends between front end portions of the of the first and second seating sections;

a front toilet bowl side portion extends outward and away from both outer front end portions of said first seating section and said second seating section;

a first toilet bowl forward side portion resides rearward and outward of said front toilet bowl side portion and extends outward and away from an outer side portion of said first seating section; and wherein said upper toilet bowl portion configured to overlap a front end wall surface of a toilet bowl; said front side portion configured to overlap a front outer side surface of said toilet bowl; said first toilet bowl forward side portion configured to overlap an outer first forward side surface of said toilet bowl; and wherein, said first open end of said first passage and said second open end of said second passage form separate openings without an enclosed passage joining the two.

* * * * *